US005085524A

United States Patent [19]

Reiss, Jr.

[11] Patent Number: 5,085,524

[45] Date of Patent: Feb. 4, 1992

[54] TABLESLIDE ASSEMBLY

[75] Inventor: Thomas J. Reiss, Jr., Watertown, Wis.

[73] Assignee: Watertown Tableside Company, a division of Consolidated Industries, Inc., Watertown, Wis.

[21] Appl. No.: 493,502

[22] Filed: Mar. 14, 1990

Related U.S. Application Data

[63] Continuation of Ser. No. 428,210, Oct. 27, 1989, Pat. No. 4,936,691, which is a continuation of Ser. No. 275,116, Nov. 22, 1988, Pat. No. 4,925,319.

[51] Int. Cl.[5] ..... F16C 17/00

[52] U.S. Cl. ..... 384/17; 108/83

[58] Field of Search ..... 384/17, 20–23, 384/42; 108/65, 83

[56] References Cited

U.S. PATENT DOCUMENTS

Re. 4,317 4/1871 Carter et al. ..... 384/17

257,274 5/1882 Bauer ..... 384/17

1,305,310 6/1919 Schloerb ..... 384/17

3,927,918 12/1975 Dobbratz ..... 384/23

*Primary Examiner*—Thomas R. Hannon

*Attorney, Agent, or Firm*—Foley & Lardner

[57] ABSTRACT

A guide block for use in an extendable tableslide mechanism of the type having at least two adjacent slide members disposed on opposite sides of the guide block, comprising a first dovetail shaped projection having a first upper inclined surface, a first lower inclined surface, and a first side surface therebetween, and second dovetail shaped projection having second upper inclined surface, a second lower inclined surface, and a second side surface therebetween, wherein the first and second upper and lower inclined surfaces are inclined with respect to a horizontal plane at an angle and wherein the respective widths of the first upper and second lower inclined surfaces one greater than the width of the first lower and second upper inclined surfaces.

1 Claim, 2 Drawing Sheets

TABLESLIDE ASSEMBLY

This is a continuation of U.S. Ser. No. 428,210 filed on Oct. 27, 1989 U.S. Pat. No. 4,936,691 which in turn was a continuation of U.S. Ser. No. 275,116 filed on Nov. 22, 1988, now U.S. Pat. No. 4,925,319.

BACKGROUND OF THE INVENTION

1. Technical Field

The present invention relates, generally, to extension tables having integral slide assemblies for supporting at least one supplemental interior table-top leaf when the table is extended, and, more particularly, to tableslide assembly elements made from materials which contribute to decreased production costs and increased performance characteristics.

2. Description of the Background Art and Technical Problems

It is generally known to provide slide assemblies for extension tables to permit the ends of a table to be extended or moved apart so that additional leaves may be inserted between the extended ends. See, Dobbratz U.S. Pat. No. 3,927,918, issued Dec. 23, 1975, the disclosure of which is hereby incorporated by reference and relied upon.

In a typical tableslide assembly, one slide member is secured to the underside of one end of an extension table while an adjacent slide member is secured to the opposite end, the adjacent slide members having respective oppositely disposed bearing surfaces. As the table ends are moved apart or urged together, those bearing surfaces of adjacent slide members maintain relative sliding engagement.

Each slide member includes a lengthwise channel formed in the bearing surface thereof. A guide block is disposed between adjacent slide members. The guide block advantageously comprises a pair of oppositely disposed projections for receipt within the respective channels of the slide members. The projections are configured to generally correspond to the geometry of the channel, for example in a male/female relationship. The dimensions of the projections are preferably slightly less than the corresponding dimensions of the channel to allow the former to freely slide within the latter. More specifically, a range of acceptable dimensions, or a tolerance, is associated with each guide block and channel, resulting in a loose fit configuration, within predetermined boundaries, for each projection/-channel combination.

During the design phase, an optimum magnitude is assigned to each dimension (i.e., length, width, height, taper, thickness, radius, for example) associated with respective tableside elements. The maximum amount of relative slop which can be tolerated between a projection and a channel is then determined, and a range of allowable deviation from the optimum value is assigned to each dimension. This range, or tolerance, constitutes the range of acceptable dimensional integrity. Individual elements having dimensions outside the tolerance are either reworked or disgarded.

When the extension table is in the extended position, the assembly, and particularly the guide block, must bear the substantial load attributed to the weight of the tabletop insert and any objects placed thereupon. Thus, the block should be made from a material which possesses sufficient strength, yet at the same time is cost effective to manufacture. Similarly, the slide members should be made from a material having good strength and manufacturability characteristics.

To prevent the mid-portion of an extended table from sagging when objects, for example dishes or books, are placed thereon, it is desirable to incorporate a camber into the tableslide design. That is, the tableslide assembly elements are configured such that, in the unloaded but extended position, the slide members are inclined upwardly towards the middle of the table. When the tabletop leaf is put in place, the upward arching of the tableslide assembly is loaded downwardly and the table assumes a horizontal position. The extent to which sagging of the mid portion of the table can be compensated for is limited by the degree of camber actually or potentially embodied in the tableslide assembly. The degree or slope of the camber, however, is determined by the dimensions of the respective tableslide assembly elements. As such, to the extent the dimensions of any particular element approach or exceed the desired tolerance, a corresponding reduction in camber results. Thus, maximizing the extent to which table sag can be compensated for involves minimizing the amount of camber which is consumed by excessive dimensional deviations (i.e., slop).

An important consideration in the selection of slide member and guide block materials is the ease with which dimensional integrity may be maintained during manufacture. Wooden tableslide members, used in conjunction with wooden guide blocks, are generally well known. See, for example, Carter and Mets Reissue U.S. Pat. No. 4,317, reissued Apr. 4, 1871 (reissue of U.S. Pat. No. 44,073, issued Sept. 6, 1864). Wooden tableslide members are easy to manufacture and relatively inexpensive. However, wooden slide members tend to warp and thus do not maintain good dimensional integrity during temperature and humidity changes, especially over long periods of time.

Alternatively, steel and aluminum slide members, in conjunction with plastic guide blocks, have been suggested. See U.S. Pat. No. 3,927,918. These materials exhibit good dimensional integrity despite temperature and humidity changes. On the other hand, the materials are generally more expensive and more difficult to fabricate than wood. Steel slide members have an additional disadvantage inasmuch as they are subject to corrosion.

Another important design consideration involves the ease with which an extension table may be pulled apart or urged together. Guide blocks made from high lubricity plastics having a low coefficient of sliding friction have been suggested for use in conjunction with aluminum slide members. See U.S. Pat. No. 3,927,918. Also as discussed in the '918 patent, the plastic guide blocks include thin flat extensions, or fins, adapted for disposition between the mating surfaces of the aluminum slides to prevent contact between adjacent slide members, thus reducing friction and noise. These fins, however, tend to warp during cooling if injection molded, are difficult to eject from an injection press, and can render a tableslide inoperable if a fin breaks during use.

SUMMARY OF THE INVENTION

The present invention provides a tableslide mechanism for use in extension tables in a manner which minimizes variations in guide block dimensions, while at the same time utilizing materials which have good strength characteristics and which are relatively inexpensive to manufacture. This is accomplished in one aspect of the invention by providing a pair of wooden slide members, each having a lengthwise recess formed in the bearing surface thereof, and a plastic guide block for sliding engagement disposed therebetween, The combination of a plastic guide block and wood slide member yields optimum, although not necessarily minimum, tolerances for the combination. The guide block comprises oppositely disposed male extensions for receipt within and sliding engagement with the channels in the slide members. In this way, the coefficient of friction between the guide block and the tableslide is minimized, thus reducing noise. The low coefficient of friction also allows the table ends to be urged together or moved apart with relative ease.

In another aspect of the invention, the guide blocks are configured to substantially eliminate contact between adjacent slide members without the use of guide block fins.

A further advantage of the present invention is that the desired degree of camber may be maintained because of the typically narrow tolerances associated with the plastic guide blocks. That is, repeatability and dimensional integrity of plastic guide blocks, particularly injection molded plastic guide blocks, is typically quite good. Moreover, the cost to produce injection molded guide blocks is a function of, inter alia, the complexity of the part. The present invention provides a simple, finless block of unitary construction having tactile indicators which obviate the need for visual inspection of the part during assembly.

DETAILED DESCRIPTION OF A PREFERRED EXEMPLARY EMBODIMENT

The present invention relates, generally, to extension tables having integral slide assemblies for supporting one or more table-top inserts when the ends of the table are extended. In a particularly preferred embodiment, the tableside assembly comprises adjacent wooden slide members slidably disposed relative to each other, coupled together by one or more plastic guide blocks.

A specific implementation of the present invention relates to a guide block having two oppositely disposed complimentary geometrical configurations extending therefrom. Each projection is slidably received, in a male/female relationship, within a similarly shaped lengthwise channel formed in a slide member. The assembly elements are configured such that an upward arching, or camber, results when the assembly is extended so that the table assumes a horizontal position when the arched slide members are loaded downwardly with the table-top inserts. The dimensions of each plastic guide block are maintained within narrow boundaries to ensure that the desired camber results.

Figure 1:
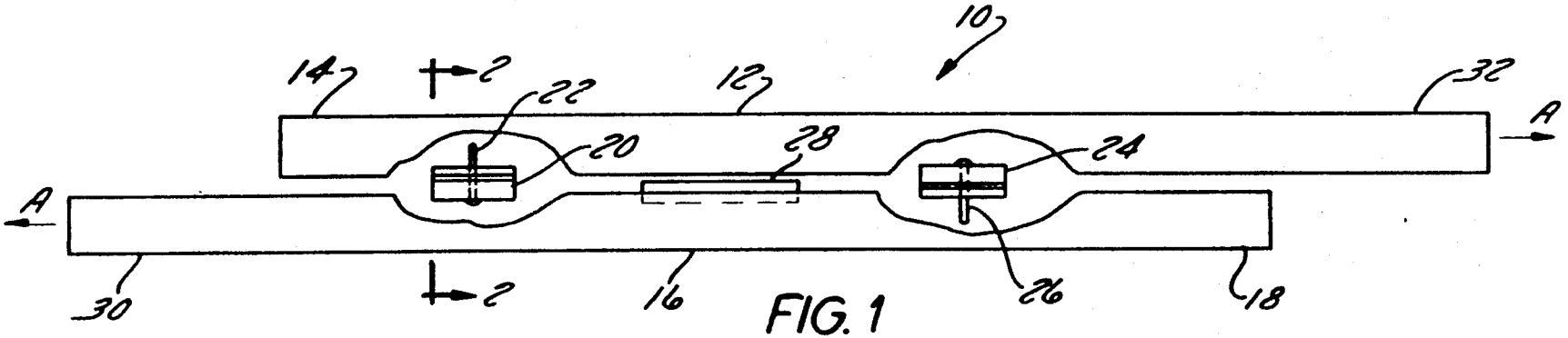
FIG. 1 is a top elevation view of the tableslide assembly in accordance with the present invention with parts broken away to reveal internal construction.

Referring now to FIG. 1, a tableslide assembly 10 in accordance with a preferred embodiment of the present invention generally comprises a first slide member 12, having a proximal end 32 adapted to be secured to the underside of a first end of an extension table, and an adjacent second slide member 16, having a proximal end 30 adapted to be secured to the underside of the oppositely disposed second end of an extension table. A first guide block 20 is secured, for example by a nail 22, to first slide member 12; a second guide block 24 is secured, for example by a nail 26, to adjacent slide member 16. Guide blocks 20 and 24 are conveniently identical, albeit asymmetrical, thus facilitating interchangeability of assembly elements and thereby reducing production costs.

The assembly of FIG. 1 is shown in the partially extended position. During extension of the table, i.e., as slide members 12 and 16 are moved in the direction of the arrows A, guide block 24 (secured to slide member 16) slidably engages a channel formed in slide member 12, and guide block 20 (secured to slide member 12) slidably engages a channel formed in slide member 16 (channels not shown in FIG. 1; see FIG. 2). Guide blocks 20 and 24 move towards each other when the assembly is extended and away from each other when the assembly is pushed back together A lap stick 28 is desirably disposed within one or both of the channels to limit relative travel between slide members 12 and 16, and hence limit the extension of slide assembly 10. Lap stick 28 may be any desired length and need not be secured to either slide member As discussed in greater detail below, each guide block is disposed such that the distal end 18 of slide member 16 is inclined upwardly (out of the page in FIG. 1) with respect to proximal end 30 of slide member of 16 when slide assembly 10 is in the extended position. Similarly, the distal end 14 of slide member 12 is inclined upwardly (out of the page in FIG. 1) with respect to proximal end 32 of slide member 12 when slide assembly 10 is in the extended position. This upward sloping of the slide members produces the desired camber effect.

Figure 2:
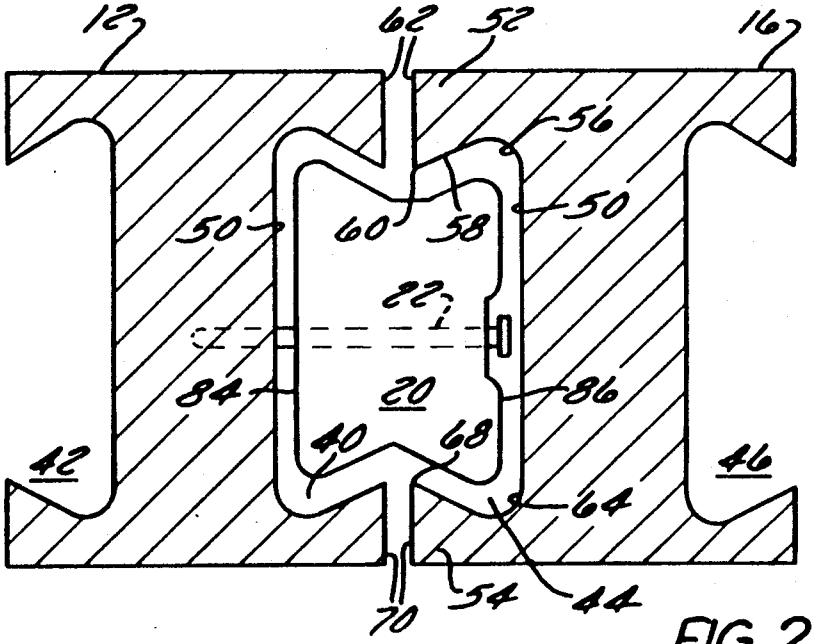
FIG. 2 is a cross-section view of the assembly taken along the line 2—2 in FIG. 1.

Referring now to FIG. 2, adjacent slide members 12 and 16 are desirably identically configured, with guide block 20 being slidably disposed therebetween. Slide assembly 12 comprises a lengthwise channel 40 configured to receive at least a portion of guideblock 20; slide member 16 similarly comprises a lengthwise channel 44 for receipt of and sliding engagement with at least a portion of guide block 20. Guideblock 20 is secured to slide member 12 by nail 22 such that it does not move with respect thereto. Slide member 12 further comprises a channel 42 so that, if desired, one or more additional slide members may be joined to the assembly in the same manner in which slide members 12 and 16 are engaged, i.e., through the interaction of a guide block. Similarly, slide member 16 comprises a channel 46 adapted to accommodate additional guide blocks and slide assemblies, as desired. Depending on table length and maximum desired extension, a slide assembly may comprise up to six eight slide, or more members. Typically, two sets of parallel slide assemblies are used in connection with an extension table.

Guide block 20 suitably comprises oppositely disposed complementary geometrical configurations 84 and 86 projecting outwardly therefrom. Projections 84 and 86 are received within channel 40 of slide member 12 and channel 44 of slide member 16, respectively. To facilitate sliding engagement while maintaining effective load distribution, channels 40 and 44 are suitably configured to generally correspond to the shape of projections 84 and 86, most preferably in a male/female relationship. For example, projections 84 and 86 of guide block 20 are illustratively male dovetail shaped and channels 40 and 44 of guide blocks 12 and 16, respectively, are female dovetail shaped.

More particularly, channel 44 comprises the region bounded by a web portion 50 having an upper portion terminating at a flange 52 and a lower portion terminating at a flange 54. Flange 52 suitably comprises a notch 56, an inclined portion 58, a radius 60, and an upper mating or bearing surface 62. Likewise, lower flange 54 comprises a notch 64, an inclined portion 66, a radius 68, and a lower mating surface 70. Mating surfaces 62 and 70 are suitably coplanar. The depth of channels 40 and 44 extends from web 50 to bearing surfaces 62 and 70.

During extension and retraction of assembly 10, block 20 remains secured to slide member 12 and slidably engages slide member 16, projection 86 being retained by respective flanges 52 and 54. As previously discussed with respect to FIG. 1, similarly configured block 24 is secured to slide member 16 and slidably engages slide member 14 in a similar manner.

Figure 3:
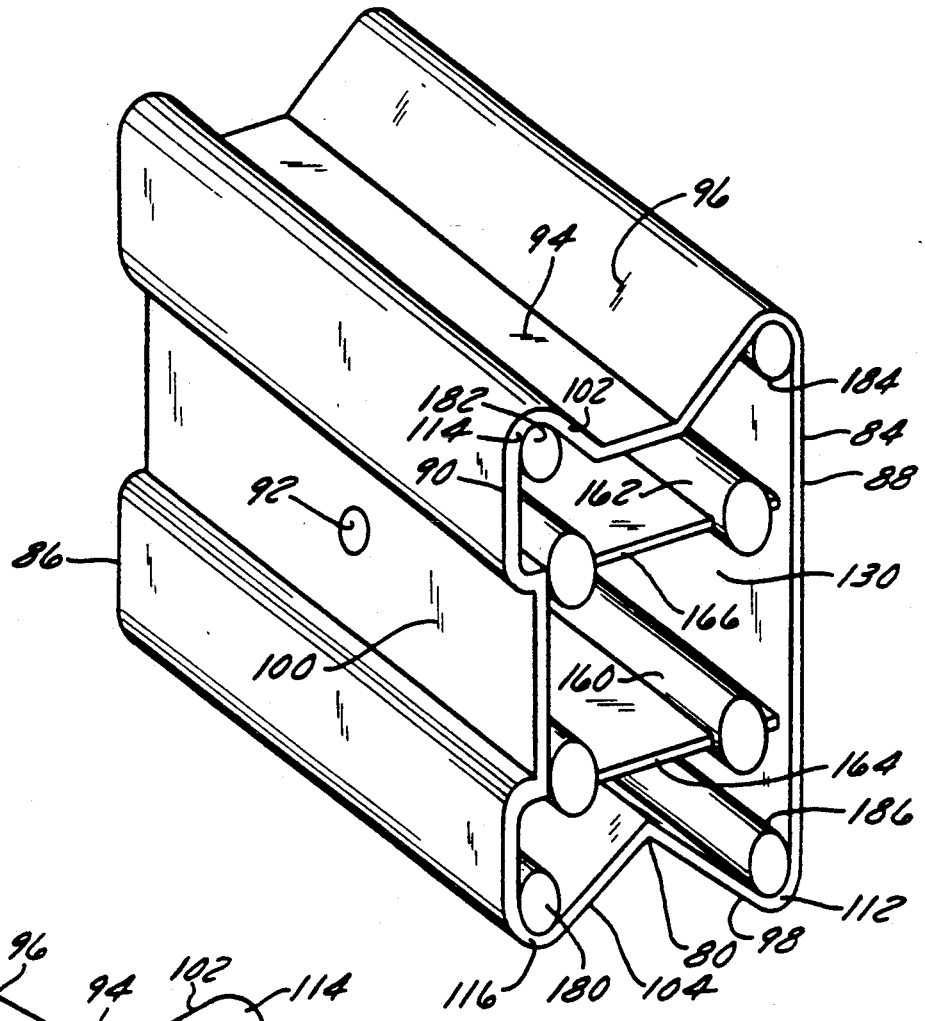
FIG. 3 is a perspective view of the front end of an exemplary guide block in accordance with the present invention.

Referring now to FIG. 3, guide block 20 comprises a single-piece block of unitary construction advantageously made by an injection molding process. Guide block 20 illustratively comprises an open front end 130, a closed rear end 132 (not shown in FIG. 3; see FIG. 4), and respective side surfaces 88 and 90. A longitudinal recess 100 is disposed along side surface 90. At the top of guide block 20, oppositely disposed male dovetail shaped projections 84 and 86 terminate at a land 94 lying in an approximately horizontal plane. At the bottom end of block 20, dovetail projections 84 and 86 comprise a chevron 80, having an angle in the range of 90 to 160 degrees, preferably in the range of 115 to 145 degrees, and most preferably approximately 130 degrees. A hole 92 for receiving nail 22 is disposed in recess 100 at a point approximately half way along the length of block 20. During assembly, nail 22 is manually guided through hole 92 and secured, through side wall 88, into web 50 of the slide member channel.

Male dovetail shaped projection 84 suitably comprises an upper inclined surface 96, a lower inclined surface 98, and a vertical surface 88 disposed therebetween. Male dovetail projection 86 comprises an upper inclined surface 102 and a lower inclined surface 104 with a vertical surface 90 disposed therebetween.

With continued reference to FIG. 3, the internal structure of guide block 20 comprises respective pairs of columnar support structures 160 and 162, having flat portions 164 and 166, respectively, integral therewith and extending from surface 90 to surface 88. As is known in the art, these structural support members are tapered from closed end 132 to open end 130 of guide block 20 to facilitate removal of the guide block from an injection molding machine. Respective reinforcing members 180, 182, 184, and 186 are disposed at the upper and lower edges of side surfaces 88 and 90. Together with columnar support structures 160 and 162, these internal components substantially eliminate dimensional distortion during cooling of guide block 20 after injection molding, as is known in the art. Moreover, these components contribute to the strength of the guide blocks during use.

Figure 4:
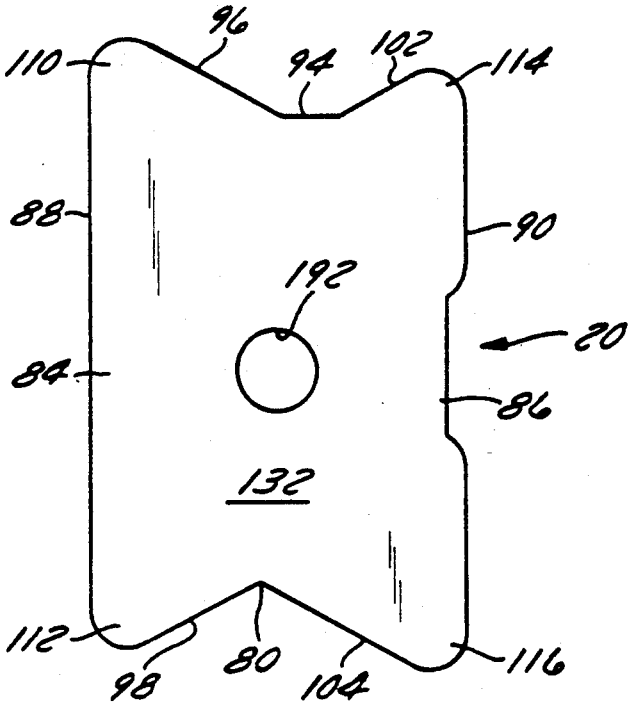
FIG. 4 is a rear elevational view of the guide block of FIG. 3.

FIG. 4 illustrates the closed end 132 of the preferred embodiment of the guide block shown in FIG. 3. Geometrical configuration 84 is disposed upwardly with respect to the complementary geometrical configuration 86. Although projections 84 and 86 are illustratively dovetail shaped, satisfactory results may be obtained using any suitable configuration which maintains a substantially parallel relationship between bearing surfaces of adjacent slide members while elevating one slide member with respect to the other.

Projection 84 terminates at a side surface 88, and projection 86 terminates at a side surface 90. The distance between respective surfaces 88 and 90 is in the range of about 0.400 and 0.600, and most preferably approximately 0.500 inches. A locating hole 192 is disposed on closed end 132 of guide block 20 approximately half way between surfaces 88 and 90. Hole 192 helps center block 20 during injection molding thereof, as is known in the art.

With continued reference to FIG. 4, an inclined surface 96 and the upper portion of vertical surface 88 terminate at a first angled portion 110, and an inclined surface 98 and the lower portion of vertical surface 88 terminate at an angled portion 112. Similarly, an inclined portion 102 and the upper portion of vertical surface 90 terminate at an angled portion 114, and an inclined portion 104 and the lower portion of vertical surface 90 terminate at an angled portion 116. The width of inclined surface 96, from angled portion 110 to land 94, is illustratively grater than the width of inclined surface 98 from angled portion 112 to chevron 80. Similarly, the width of inclined surface 104, from angled portion 110 to chevron 80, is illustratively greater than the width of inclined portion 102 from angled portion 114 to land 94.

Inclined surfaces 96, 98, 102 and 104 are illustratively inclined with respect to a horizontal plane at an angle having a magnitude in the range of about 10 to 45 degrees, preferably about 20 to 30 degrees, and most preferably about 25 degrees.

An imaginary vertical line through the center of locating hole (bore) 192 defines the centerline of guide block 20. Land 94, upon which inclined surfaces 96 and 102 terminate, is advantageously disposed to the right of the centerline. Inclined surfaces 96 and 102 are preferably disposed at approximately the same angle with respect to the plane of land 94, which angle is illustratively in the range of about 25 degrees.

The vertex of chevron 80, on the other hand, is advantageously disposed to the left of the centerline. Inclined surfaces 98 and 104 are preferably disposed at approximately the same angle with respect to a horizontal line, which angle is illustratively in the range of about 25 degrees As best viewed in FIGS. 2 and 4, male dovetail portion 84 extends above male dovetail portion 86. More particularly, angled portion 110 extends above angled portion 114 and angled portion 112 extends above angled portion 116. With reference now to FIGS. 1, 2 and 4, block 20 is secured to slide member 12 and block 24 is secured to slide member 16 such that open end 130 of guide block 20 is proximate guide block 24 and open end 130 of guide block 24 is proximate, i.e., faces, guide block 24. In normal operation, land 94 is directed upwardly and chevron 80 is directed downwardly in both guide blocks. Consequently, that portion of slide member 12 which slideably engages guide block 24 is urged downwardly with respect to that portion of slide member 16 which is rigidly secured to guide block 24. Similarly, that portion of slide member 16 which slideably engages guide block 20 is urged downwardly with respect to that portion of slide member 12 which is rigidly secured to guide block 20. In this manner, distal end 18 of slide member 16 is inclined upwardly with respect to proximal end 30 of slide member 16 and distal end 14 of slide member 12 is simultaneously urged upwardly with respect to proximal end 32 of slide member 12 as assembly 10 is extended in the direction of arrows A in FIG. 1. This complimentary relative inclination produces the desired camber.

With particular reference to FIG. 1, as distal end 18 of slide member 16 is urged upwardly with respect to proximal end 30 of slide member 16, block 20 acts as a fulcrum for slide member 16, the proximal end of which is rigidly secured to the underside of one end of an extension table. The interaction between slide members 12 and 16 and guide block 20 results in the application of torsional stresses to block 20 about an axis approximately coincident with nail 22. In addition, block 20 is subject to transverse torsional stresses about the longitudinal axis of block 20 approximately coincident with hole 192 as slide member 12 is urged upwardly with respect to slide member 16 (see FIGS. 2 and 4). The applied torsional stresses produce characteristic torsional strains on the guide blocks each time assembly 10 is extended. The stresses along both of the above-identified axes may be relieved or exacerbated when the table top insert leaf (or any objects placed thereon) is placed on the assembly, depending on the magnitude of the load.

An important feature of the present invention involves the ability of guide block 20 to withstand significant torsional, shear, and bending stresses without failure. This, in large measure, is due to the geometrical configuration of the block. In particular, the presence of land 94, as opposed to a chevron similar to that of chevron 80, allows a given load to be spread out over a greater volume of load bearing material.

Another important feature of the present invention is the inventive selection of materials from which the guide blocks and slide members are made. In the most preferred embodiment, the slide members are made from wood. However, the advantageous features of the guide block can be obtained with a variety of suitable slide member materials, for example, aluminum, steel, or plastic.

Another advantage of the present invention surrounds the ease with which the tableslide assembly may be extended and retracted. One contributing factor is the high lubricity of the plastic material from which the guide blocks are made. The plastic material suitably comprises a glass filled nylon composition having in the range of about 20% to 45% glass content, and most preferrably approximately 33%. A suitable composition is DuPont 70G331, available from the DuPont Chemical Corporation of Parkersburg, W.V. Guide blocks made from this material by well known injection molding techniques exhibit a very low degree cf deviation from predetermined desired dimensional values. In addition, the single piece unitary construction allows for a seamless block, which eliminates stress concentrations which can occur at a seam and premature failure of the part over an extended period of time.

The tableslide assembly of the present invention not only minimizes friction between the guide blocks and the slide members, but also substantially eliminates friction between the bearing surfaces of adjacent slide members. The guide block/slide member configuration described herein allows adjacent slide members to be separated by the guide block without the necessity for fins extending from the guide block interposed between slide member bearing surfaces. In a preferred embodiment, the thickness of guide block 20, i.e., the distance from surface 88 to surface 90, is approximately 0.500 inches. With reference to FIG. 2, if the depth of channel 44, i.e., the distance between bearing surface 62 and web 50, does not exceed one-half the thickness of block 20, contact between adjacent slide members may be substantially eliminated during use.

As best seen in FIG. 3, recess 100 allows an assembly workman to insert the guide blocks into the slide member in the proper orientation, i.e., with land 94 facing upwardly and respective open surfaces 130 of respective blocks 20 and 24 facing each other. That is to say, visual examination during assembly is unnecessary: tactile examination is sufficient. This feature facilitates enhanced part production per unit time.

In prior art tableslide assemblies wherein wood guide blocks were used in conjunction with wood slide members, nailing or gluing the guide block to a slide member did not produce completely satisfactory results due to the temperature and humidity effects on the dimensions of the wood parts. If different types of wood were used for the guide block and slide member, the problem was exaggerated due to the different expansion rates of the parts. Accordingly, a common practice has been to use a plurality of nails alone or in combination with glue, a practice which involves extensive labor and material costs. Moreover, if the slide member is made from a material other than wood, it may be difficult to penetrate the slide member with a nail. The present invention, on the other hand, allows the guide block to be secured to the wood with a single nail.

It will be understood that the foregoing description is of preferred, exemplary embodiments of the present invention and that the invention is not limited to the specific forms shown. For example, the configuration of the guide block projections and channels need not be dovetail shaped; they may be of any suitable shape which facilitates sliding engagement. Furthermore, land 94 may be suitably replaced with a chevron or the positions of land 94 and chevron 80 may be inverted. Also, the guide block may exhibit axial or planar symmetry as long as one slide member is urged upwardly with respect to the adjacent slide member in order to achieve the desired camber. These and other modifications may be made in the design and configuration of the components without departing from the spirit of the invention as expressed in the appended claims.

I claim:

1. An extendable tableslide assembly for supporting a supplemental table-top leaf of an extension table, comprising:

a first wooden slide member having a first bearing surface and having a first longitudinal channel disposed on said first bearing surface;

a second wooden slide member having a second bearing surface disposed opposite to and adjacent to said first bearing surface and having a second longitudinal channel disposed on said second bearing surface; and, a plastic guide block disposed between and joining said first and second wooden slide members and having a first projection for receipt within said first channel and a second projection for receipt within said second channel, said plastic guide block being suitably configured such that said bearing surfaces of said wooden slide members are substantially free from contact with respect to each other, with respect to said plastic guide block, and with respect to any member affixed to said plastic guide block or said bearing surfaces during extension and retraction of said assembly;

wherein said first projection is rigidly secured within said first channel and said second projection is slidably engaged within said second slide member, and wherein said plastic guide block exhibits a high degree of lubricity to thereby minimize friction between said second projection of said plastic guide block and said second wooden slide member during extension and retraction of said assembly.

* * * * *